United States Patent [19]

Rollason

[11] 3,931,442

[45] Jan. 6, 1976

[54] TEMPORARY MODIFICATION OF A PATTERN MASK FOR USE IN FORMING A COLOR CRT SCREEN AND A PROCESS FOR MODIFYING THE SAME

[75] Inventor: Peter H. Rollason, Cayuga, N.Y.

[73] Assignee: GTE Sylvania Incorporated, Stamford, Conn.

[22] Filed: Nov. 4, 1974

[21] Appl. No.: 520,244

Related U.S. Application Data

[63] Continuation of Ser. No. 337,361, March 2, 1973, abandoned.

[52] U.S. Cl. ..... 428/336; 427/64; 427/346; 428/442; 428/522

[51] Int. Cl.[2] ..... H01J 31/00

[58] Field of Search ..... 117/33.5 C, 33.5 CM; 96/36.1; 428/336, 522, 442; 427/64, 346

[56] References Cited

UNITED STATES PATENTS

| | | | |
|---|---|---|---|
| 3,616,732 | 11/1971 | Ruciniki | 96/36.1 |
| 3,645,734 | 2/1972 | Noguchi | 96/36.1 |
| 3,653,900 | 4/1972 | Black | 117/33.5 CM |
| 3,653,901 | 4/1972 | Etter | 117/33.5 CM |
| 3,703,374 | 11/1972 | Okabe et al. | 96/36.1 |
| 3,725,065 | 4/1973 | Fadner | 96/36.1 |
| 3,770,434 | 11/1973 | Law | 96/36.1 |
| 3,775,116 | 11/1973 | Takemoto | 96/36.1 |

*Primary Examiner*—Bernard D. Pianalto
*Attorney, Agent, or Firm*—Norman J. O'Malley; Robert T. Orner; Frederick H. Rinn

[57] ABSTRACT

The invention provides a temporary light attenuation coating modification of the apertures in a multi-apertured pattern member for utilization in selected steps of the procedure for fabricating a patterned color screen structure disposed on the interior surface of a cathode ray tube viewing panel. The modification is in the form of a dried coating of a water-soluble polyhydric secondary alcohol uniformly covering the apertured portion of the pattern member to effect a bridging meniscus of coating in each of the apertures. Dissolved in the coating vehicle is a homogeneous dispersion of a ultraviolet absorbing material. Each attenuating meniscus effects a differential or graded degree of uv absorption resultant of the inherent variation in thickness of the bridging formation and the amount of uv absorber dissolved therein. In addition, the absorptive coating residual on the interstitial areas defining the apertures reduces deleterious reflections of actinic radiation during screen structure fabrication.

4 Claims, 5 Drawing Figures

TEMPORARY MODIFICATION OF A PATTERN MASK FOR USE IN FORMING A COLOR CRT SCREEN AND A PROCESS FOR MODIFYING THE SAME

CROSS REFERENCE TO RELATED APPLICATION

This application is a continuation of Ser. No. 337,361, filed Mar. 2, 1973 and now abandoned.

BACKGROUND OF THE INVENTION

This invention relates to color cathode ray tubes and more particularly to the temporary modification of the apertured pattern member utilized in the forming of a patterned color screen structure.

Color cathode ray tubes employed in the presentation of multi-color display imagery, such as color television, usually have patterned screens comprised of repetitive groups of related phosphor materials. These phosphor groupings are of various shapes of which dot-like areas are a common deposition.

An apertured pattern member is usually positioned in spaced relationship with the screen, which in a post deflection type tube, functions as a grid in the finished tube and is usually priorly utilized in disposing the patterned screen on the interior surface of the face panel. In the well-known shadow mask tube construction, the screen pattern is also formed by utilizing a spatially oriented multiple aperture member. Regardless of which tube structure is considered, each of the openings in the apertured pattern member is related to specific grouping of phosphor elements in a spaced manner to enable selected electron beams traversing the apertures to impinge the proper pattern elements therebeneath. Usually the individual phosphor elements of the screen pattern are separated from one another by relatively small interstitial spacings which enhance color purity by reducing the possibility of adjacent color-emitting elements being excited by a specific electron beam.

It has been found that improved contrast of the color screen image can be achieved by disposing an opaque light-absorbing material in the interstitial spacing between the respective phosphor elements. In essence, each of the phosphor element is then surrounded or defined by a substantially dark encompassment which collectively comprise a multi-opening pattern disposed in the panel in the form of a windowed webbing having an array of substantially opaque connected interstices. While such web-like screen structures have been fabricated, either before or after phosphor screening, it has proven to be expeditious to form the windowed webbing prior to the deposition of the phosphor elements of the screen. Such web-like structures have been fabricated by several known processes wherein photo-deposition techniques play a prominent part. An example of a typical web-forming process is disclosed in Ser. No. 41,535 by R. L. Bergamo et al., filed May 28, 1970, and assigned to the assignee of this invention.

To heighten the contrast and improve registration, it has been found beneficial to have at least some of the openings in the spatially associated apertured pattern member to be of a size equal to or larger than the window areas in the opaque webbing. This aperture-to-window relationship is referenced in the art as "negative guardband" or a "window-limited" screen. In this type of screen construction, when a phosphor dot is impinged by an aperture-sized beam, the excited phosphor area completely fills the associated window area with a luminescent hue.

Several techniques have been employed to achieve a multiplex window-limited color CRT screen structure in which the window openings in the opaque interstitial webbing are smaller than the associated apertures in, for example, a shadow mask apertured member subsequently utilized in the finished operable tube.

In accordance with one screen forming procedure, wherein the sizes of the basic mask apertures remain fixed, a pattern of clear polymerized polyvinyl alcohol dots is light disposed on the interior of the panel, on those areas subsequently to be windows in the opaque webbing, by photo exposure through the related apertured shadow mask. After development, the resultant island-like polymerized dots are reduced in size by an erosion technique involving a chemical degrading agent. Next, an opaque graphite coating is applied to completely overcoat the pattern of the reduced-in-size clear dots and the adjacent bare interstitial glass areas. Then, an oxidizing agent is applied to completely degrade the pattern of dots thereby loosening the superjacent opaque coating thereon, whereupon the materials so loosened are removed by a subsequent water development step. Thus, there is formed an opaque interstitial web having multitudinous windows defined as bare glass areas that are of a size smaller than the related mask apertures. The phosphor pattern elements are then disposed on these window areas upon photo-exposure through the same size mask apertures by one of the various processes known to the art. While the aforedescribed dot-erosion procedure is an acceptable production technique, it necessitates the inclusion of additional process steps.

By another procedure, after the dot-initiated windows and the overlaying phosphor elements are formed by a separate series of photo exposures through the initially apertured mask, the mask apertures are subjected to a chemical etching process to enlarge their sizes thereby effecting the desired dimensional differential between the final-sized apertures and the formed windows in the interstitial webbing. While, this too, is a production procedure, the aperture etching requires additional closely controlled processing steps. In addition, as a result of this aperture etching procedure, metallurgical inconsistencies of the mask material have been evidenced such as a ragged aperture periphery, a weakening of the mask material per se, and destruction of the desirable dark oxide coating on the surface of the mask. Furthermore, with reference to the economics of tube production, etching of the mask apertures is an inherently costly procedure as it precludes any subsequent reuse of masks which ordinarily could be salvageable from the final stages of the tube manufacturing operation.

The prior art is replete with a variety of techniques for modifying the sizes of the shadow mask apertures for utilization in the forming or operation of specific types of color screen structures. In several disclosures the changing of aperture sizes is executed by the deposition within the aperture openings of peripheral fill-in substances applied, as for example, by painting, dipping, electrophoresis, electroplating, and vaporization.

OBJECTS AND SUMMARY OF THE INVENTION

It is an object of the invention to reduce the aforementioned disadvantages by providing a multi-apertured pattern member having temporary modifications of the apertures therein. Another object is to provide a process for effecting a temporal modification of the openings in the pattern member that does not alter the basic structure or the surface thereof.

These and other objects and advantages are achieved in one aspect of the invention by the provision of a CRT multiapertured pattern member wherein the sizes of the apertures therein are temporarily modified. The modified pattern member is advantageously utilized in selected steps of the procedure for fabricating the windowed opaque webbing and the overlying phosphor elements of the multiplex color screen structure. The temporary modification is in the form of a dried coating of a water-soluble polyhydric secondary alcohol uniformly covering at least one surface of the multi-apertured pattern member to effect a bridging meniscus of coating in each aperture therein. The discretely formed coating meniscus is formed of a continuous film bridging the central region of each aperture and merging peripherally into a gradual thickening of the coating which effects an annular supporting formation within the aperture perimeter. The coating material has dissolved therein a homogeneous dispersion of a light attenuating material that is substantially absorbent of ultraviolet radiant energy in substantially the 350 to 380 nanometer range. Thus, the meniscus effects a modification of each aperture by providing a differential or graded degree of uv absorption therein, such attenuation being resultant of the inherent variation in thickness of the bridging meniscus and the amount of dispersed uv absorbing material dissolved in the coating per se. In addition to the meniscus modifications of the apertures, the coating on the member provides a uniform uv absorbent covering for the interstitial material defining the apertures thereby reducing deleterious reflections of actinic radiation during subsequent screen structure fabrication.

DESCRIPTION OF THE PREFERRED EMBODIMENT

For a better understanding of the present invention, together with other and further objects, advantages and capabilities thereof, reference is made to the following specification and appended claims in connection with the aforedescribed drawings.

While the ensuing description is primarily directed to an exemplary window-limited shadow mask-screen assembly, the concept of utilizing temporarily modified apertures in the screen forming procedure is likewise applicable for tubes employing a focus mask-screen structure.

Figure 1B:
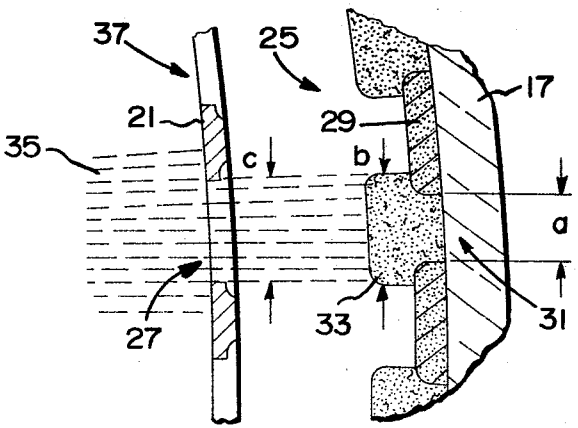
Fig. 1b PRIOR ART
FIG. 1*b* is an enlarged sectional view of a portion of the prior art screen structure as set forth in FIG. 1*a;*
Figure 1A:
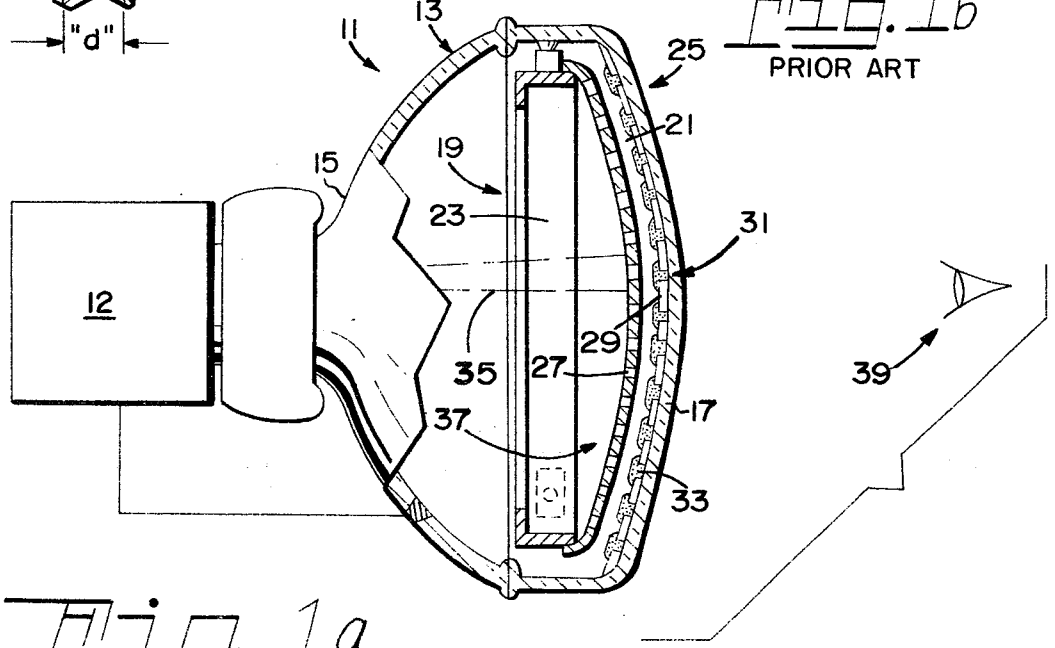
Fig. 1a PRIOR ART
FIG. 1*a* is a prior art illustration of a color cathode ray tube in an operable environment and partially in section showing the relationship of the multi-apertures pattern member to the associated screen structure formed on the viewing panel of the tube.

In referring to the drawings, FIGS. 1*a* and 1*b* illustrate prior art sectional views of a shadow mask type of color cathode ray tube 11 in an operating environment denoted diagrammatically as 12. The encompassing envelope 13 of the tube includes a funnel portion 15 to which a viewing panel 17 is suitably bonded. Within the panel there is positioned a pattern member or mask 19 which comprises a curved or domed multi-apertured portion 21 formed of, for example, an iron alloy material having a strengthening means or perimetrical frame 23 integral with the periphery thereof. Disposed on the interior surface of the viewing panel is a patterned screen structure 25, the elements of which are formed in accordance with the apertures 27 in the adjacent pattern member 21, the substantially domed contour of the mask being related to the surface contour of the interior of the panel.

The multiplex patterned screen structure is comprised of repetitive groupings of two or more elemental cathodoluminescent areas of different phosphors overlaid on the discretely formed window areas of the opaque interstitial webbing portion of the screen structure 25. For example, in the screen structure illustrated in FIGS. 1*a* and 1*b*, the opaque interstitial webbing 29 has a substantially round exemplary window area 31 which is dimensioned as *a;* such is intended to be normally representative of the multitudinous windows therein. Overlaid on multi-apertured of the respective window areas is a related phosphor area, of which phosphor pattern element 33 is representative of one of the pattern components. The phosphor area is dimensioned as *b* being at least as large as or preferably larger than the associated window area 31. To facilitate clarity in the drawing, the usually present aluminum coating or backing in the finished screen structure is omitted. Spaced rearward from the screen structure 25 is the multi-opening pattern member 21, wherein a representative aperture denoted as 27, is dimensioned as *c* and is larger than the related window area 31. The aforementioned windows and related phosphor areas are usually formed in accordance with the shapings of the apertures by known photo exposure techniques. An exemplary electron beam 35, emanating within the tube from a source not shown, is directed toward the mash-screen assembly 37. Upon striking the apertured pattern member 21, a portion of the beam that is sized by the large aperture 27, traverses therethrough, impinges a related phosphor area 33 therebeneath and substantially excites the whole of the phosphor area to a state of luminescence. Since each of the excited phosphor areas 33 in this "windowlimited" screen is as large as or larger than its associated window area 31, the total area of each window comprising the screen pattern is fully luminous. The resultant display in an operating tube is clearly discernible by the viewer 39.

The present invention provides a temporary attenuation modification of the multi-apertured pattern member, such modification being utilized in selected steps of the process for fabricating the windowed opaque webbing and the associated phosphor elements of a "window-limited" color CRT screen structure.

Figure 2A:
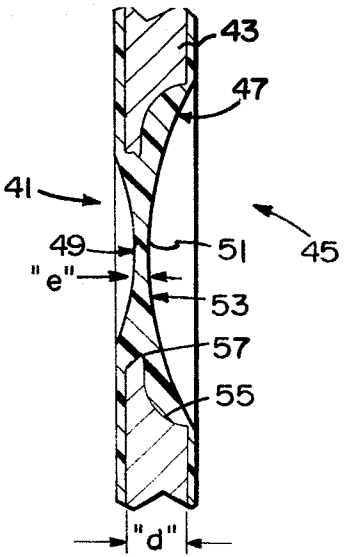
FIG. 2*a* is an enlarged sectional view of one aperture of the pattern member showing the invention.

With reference to FIG. 2*a*, an enlarged sectional view of a single aperture portion of the temporarily modified pattern member 44 is shown. This apertured member, for example, is formed of a basic metallic material 43 such as S.A.E. 1010 cold rolled steel having a conventional thickness *d* within the range of 0.005 to 0.007 of an inch, and is normally domed in a manner related to the interior contour of the viewing panel as priorly illustrated in FIG. 1*a*. The mask structure is previously subjected to a known controlled atmospheric heat treatment to form a dark coating comprising a mixture of iron oxides, not shown, on both the inner and outer surfaces thereof. It is conventionally desired to retain such dark coating for use in the finished tube to enhance efficiency and uniformity in the radiation of the heat in the apertured member induced by electron bombardment. As a result, the mask member operating temperature is lowered and heat-up distortion in the mask is noticeably reduced. It has been found that tubes having the dark coated mask members can be expeditiously and facilely adjusted to achieve optimum operational results. Therefore, it is important that the temporary modification of the invention should in no manner affect the beneficial dark iron oxide surface condition on the apertured member, nor should it in any way permanently alter the initially formed apertures therein.

An exemplary initially formed basic aperture 45 in the pattern member material 43 is normally diametrically dimensioned to be within the range of 0.010 to 0.015 of an inch, depending upon the tube size and mask design. The invention being a temporal coated modification 47 of the apertured member is consummated by applying a coating of a water-soluble polyhydric secondary alcohol, such as polyvinyl alcohol, to the apertured pattern member to cover the surface and apertures thereof. The coating has homogeneously dispersed therein a dissolved material that is substantially absorbent of ultraviolet radiant energy within substantially the 350 to 380 nanometer bandwidth range. Thus, the mask per se is covered with a film of uv absorbent material which is an important consideration in photo exposing both the basic window pattern and the subsequently disposed pattern of phosphor elements thereover. The uv absorbent material of dye dissolved in the coating minimizes deleterious reflections of the actinic exposure radiation and thereby further enhances control of the exposure procedure.

Within each aperture 45, there is formed a coating meniscus 49 which constitutes a continuous film 51 bridging the central region of the aperture and merging peripherally therefrom into a gradual thickening of coating 53 which effects annular support within the aperture perimeter 55. The meniscus formation 49 being related to the phenomenon of surface tension and the molecular forces associated therewith, assumes uniformity within each aperture. In the fabrication of the basic mask per se, the apertures are conventionally formed by established techniques involving selective etching from both surfaces which produces ledge-like internal perimetric surfaces 57. Accordingly, the molecular adhesion, exerted between the liquid coating and the contiguous metallic ledged-formation of the aperture, provides the bridging meniscus formation with an extensive peripheral supporting encompassment. Thus, each aperture is temporarily modified by a meniscus bridge of a predeterminately varied transmission medium.

The size of the aperture determines the viscosity of the applied coating which is nominally within the range of 60 to 100 centipoises for the aperture diameters under consideration. The coating vehicle is formulated from a basic or stock solution comprising 50—50 volumetric percentage of water and a $C_1 - C_2$ monohydric alcohol wherein 6 to 8 weight percent of polyvinyl alcohol solids are dissolved. To this stock solution the uv absorbent material is added along with up to 40 additional volumetric percent of a $C_1 - C_2$ monohydric alcohol to achieve the proper viscosity of the applied solution to form the meniscus and control uniform coverage, promote even run-off and drying of the coating. The $C_1 - C_2$ monohydric alcohols utilized are selected from the group consisting essentially of methanol and ethanol. Exemplary PVA solids are Elvanol 51–05 or 52–22 as manufactured by E. I. duPont de Nemours and Company (Inc.), Wilmington, Del. Since the film of the bridging meniscus is thinnest at the central portion of the aperture *e*, the degree of uv transmission is greatest in the region, the thickness thereat being in the order of at least 1 micron. As the attenuating film thickens toward the periphery, the transmission of actinic radiant energy is gradually reduced thereby effecting a temporary graded modification of the transmission of the aperture; the degree of absorptive modification being the resultant of the gradual variation in thickness of the coating meniscus and the concentration of the absorptive material dissolved therein.

The ultraviolet absorptive material dissolved in the coating is in the form of a water-soluble selective absorber, such as suitable natural or synthetic absorbing compositions and dyes. Such uv absorptive materials are, for example, a monoazo composition such as trisodium salt of 1-(4 sulfo-1-naphthylazo)-2-naphthol-3, 6-disulforic acid, which is known as Amaranth (16185), available from Fisher Scientific Company, Pittsburgh, Pa. Another suitable material is sodium 2, 2′-di-hydroxy-4, 4′-dimethoxy-5-sulfobenzophenone, known as Uvinul DS-49 as manufactured by General Aniline and Film Corporation, New York, N.Y. Still another composition is 2-hydroxy-4-methoxy-5-sulfobenzophenone trihydrate listed as Cyasorb UV 284 Light Absorber, as available from American Cyanamid Company, Bound Brook, N.J. It is not intended that the invention be limited to the aforementioned examples as additional uv absorbing materials are also suitable for inclusion in the coating.

The concentration or amount of uv absorber dissolved in the coating is dependent on the particular type of absorber employed and the degree of central transmission desired. For example, when using Amaranth the central uv transmission of the meniscus is in the order of 70 to 80 percent with a gradient decreasing to zero in the thicker peripheral region. Thus, a temporary graded transmission modification is effected in each aperture.

The application of the modification coating to the domed and formed apertured portion of the pattern member is accomplished by applying the light attenuating coating to uniformly cover at least one surface of the apertured member. This is effected by one of several techniques such as dipping, painting or spraying, of which dipping or immersion is preferred. The dipping step is executed in a susbstantially vertical manner whereby substantially only the domed apertured portion of the pattern member is immersed in the coating solution. Upon removal therefrom by a reciprocal tilting motion, the mask is then inverted in a dome-up position to promote uniformity and flattening of the coating coverage thereover. The coated mask is then dried in an environment of moving air whereof the ambient velocity is of a level insufficient to disrupt the discretely shaped meniscus coating formations retained in the apertures.

Figure 2B:
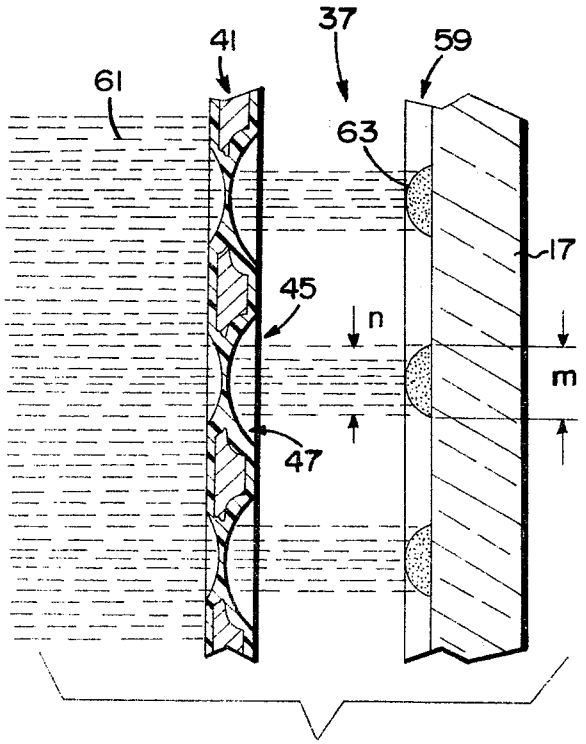
FIG. 2*b* is an enlarged sectional view of a portion of the pattern member-screen assembly illustrating utilization of the invention during one step of the procedure for fabricating the color screen structure.

In referring to FIG. 2*b*, an enlarged sectional view of a portion of the mask-screen assembly 37 is illustrated wherein the temporarily modified mask 41 is positioned for utilization in fabricating the windowed interstitial webbing of the color screen structure. The inner surface of the viewing panel 17, having been coated with a substantially clear photosensitive resist material 59, such as dichromated polyvinyl alcohol, is exposed to substantially actinic light 61, from a discretely located source not shown, which is beamed through the temporarily modified apertures of the positioned shadow mask 41. In those photoresist areas 63 impinged by the restricted actinic exposure radiation, the affected area of sensitized coating is light-polymerized as a graded pattern dot having the dimension *m*, this being directly related to the reduced dimension *n* of the actinic light beam which is sized by the graded transmission of the meniscus-modified aperture 45.

Figure 3:
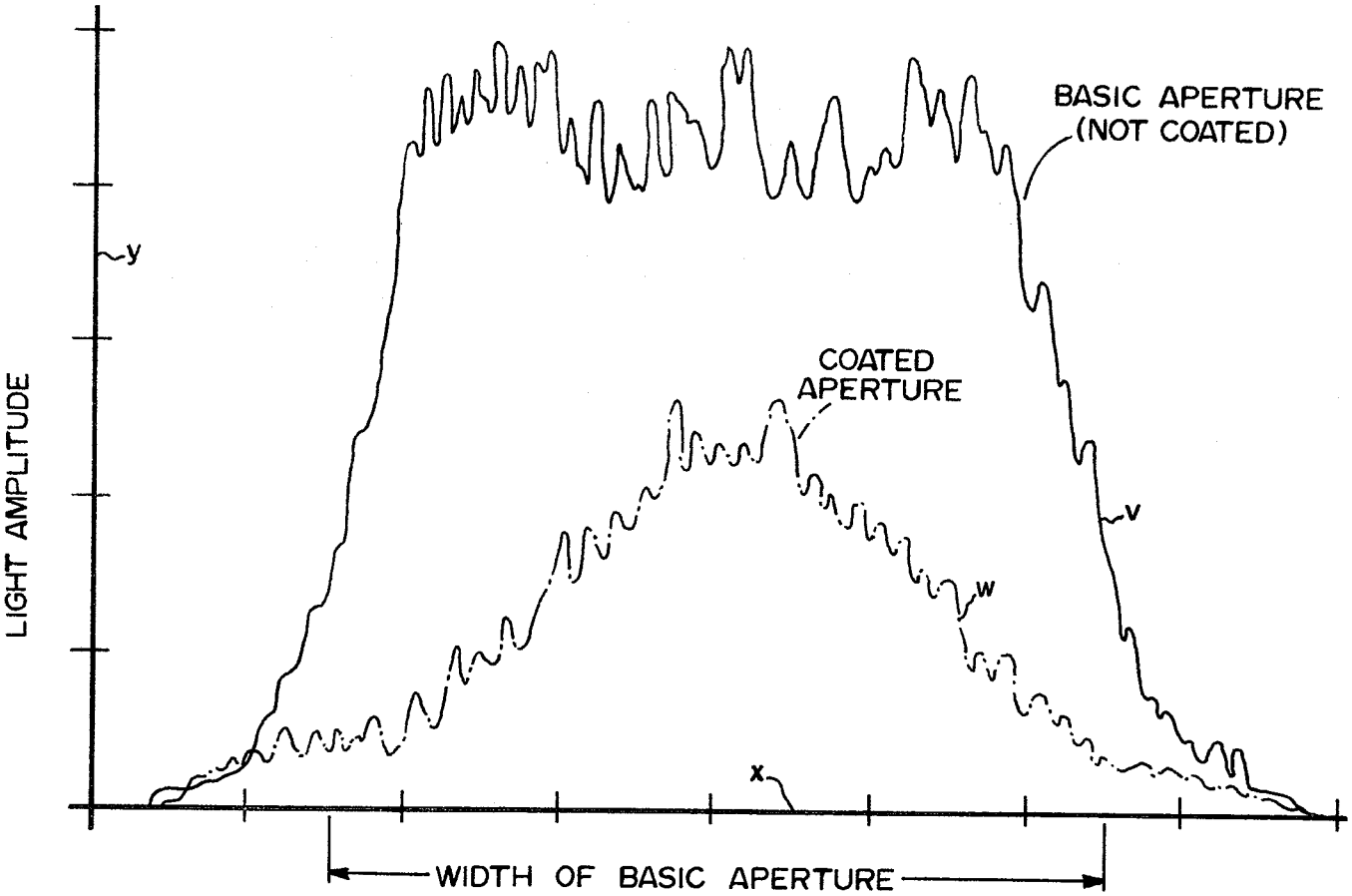
FIG. 3 are plottings of radiant energy transmission through an un-modified aperture of a pattern member compared with a related radiant energy transmission through a temporarily modified aperture according to the invention.

The graded light transmission of the meniscus modification of the apertures is further illustrated by reference to FIG. 3, wherein competitive plottings of actinic radiant energy transmission through both the modified and un-modified apertures of a pattern member are shown. The *x* axis is indicative of the aperture width and the *y* axis that of light amplitude or intensity. Movement along the *y* axis towards the *x* axis denotes lengthening of exposure. To attain these plottings, a testing set-up was arranged to beam actinic radiation from substantially a point area of a mercury arc source through respective apertures in a pattern member. The radiant energy traversing each aperture was measured at a plane removed from the plane of the mask at a position comparable to impingement of the beam on the panel surface. The measurement was made by moving a 0.002 inch fiber optic probe across the aperture in a plane parallel therewith, the probe being connected to a Photometric Microscope as available from Gamma Scientific Inc., San Diego, Calif. The plotting *v* is illustrative of radiant energy transmission through a basic or un-modified aperture of a pattern member such as aperture 27 in prior art FIG. 1. The actinic energy traversing the basic opening is substantially defined by the aperture dimensioning. In comparison therewith, the actinic light traversing a temporarily modified aperture, of like basic dimensioning, such as that illustrated in FIGS. 2*a* and 2*b*, is delineated by plotting *W*. The graded attenuation effected by the coating modification is evidenced in the reduced lateral dimension of the light beam as "sized" by the meniscus and the lessened intensity thereof. The plotting *w* clearly shows the graduated attenuation of the radiant energy traversing the varied thickness of the coating meniscus. Since the attenuating modification of the apertures selectively reduces the energy transmission therethrough in the order to 20 to 30 percent, it is desirable to employ a light source of higher intensity and/or a lengthened period of exposure, but such factors are not considered detrimental as the benefits of the temporary attenuation modifications are distinctly advantageous in expeditiously controlling size relationships of screen elements during the screening forming process.

In again referring to FIG. 2*b*, the polymerized pattern dot 63 subsequently becomes a window in the opaque interstitial webbing of the color screen structure such as taught in the previously mentioned web-forming procedure disclosed in U.S. patent application Ser. No. 41,535 by R. L. Bergamo et al. After forming of the basic window pattern, as exemplified by the polymerized area 63, and the subsequent similarlly disposed overlaid pattern of phosphor elements, not shown; the dry temporal meniscus coating 47 is then expeditiously removed from the surface and apertures of the mask member 43 by a water treatment. Such coating removal procedure, being an immersion and/or water rinse, is in no way deleterious to the basic mask material. The precisely formed apertures are maintained as initially fabricated, and the dark iron oxide coating formed on the surface of the mask is desirably retained to enhance uniform heat radiation in the finished tube.

While there has been shown and described what is at present considered the preferred embodiment of the invention, it will be obvious to those skilled in the art that various changes and modifications may be made therein without departing from the scope of the invention as defined by the appended claims.

What is claimed is:

1. In a screen-related multi-apertured pattern member as used in a color cathode ray tube, a temporary modification improvement of the apertured portion for utilization during at least one selected radiant energy exposure step of the procedure for fabricating a patterned screen structure disposed on the interior surface of an associated viewing panel, said temporary modification improvement comprising:

a dried light-attenuating coating of a water-soluble polyhydric secondary alcohol in the form of a polyvinyl alcohol solution substantially uniformly covering both surfaces of said apertured member to effect a bridging meniscus of coating in each aperture thereof, said coating being formed from a homogeneous solution of a 50–50 volumetric percentage of water and a $C_1$–$C_2$ monohydric alcohol having six to eight weight percent of polyvinyl alcohol solids dissolved therein, said coating meniscus being formed of a continuous film bridging the central region of said aperture and merging peripherally into a gradual thickening of coating effecting annular support within the aperture perimeter, the central region of said meniscus having a minimum thickness in the order of one micron, said coating material having homogeneously dispersed therein a watersoluble light attenuating chemical composition substantially selectively absorbent of ultraviolet radiant energy within substantially the 350 to 380 nanometer bandwidth range as utilized in said screen exposure step, the degree of absorptive modification in each aperture being resultant of the variations in thickness of the homogeneous composition of said coating meniscus and the concentration of absorptive chemical material dissolved therein, said uv absorbent coating additionally providing a uniform covering for the interstitial maaterial defining said apertures thereby reducing deleterious reflections of actinic radiation during screen structure fabrication.

2. A process for effecting the improvement of temporarily modifying the apertured portion of a multi-apertured pattern member with a continuous bridging of the apertures subsequently utilized in forming the patterned screen structure disposed on the viewing panel of a color cathode ray tube, said modification process comprising the steps of:

formulating a homogeneous coating solution of a 50—50 volumetric percentage of water and a $C_1 - C_2$ monohydric alcohol having six to eight weight percent of polyvinyl alcohol solids dissolved therein, adding thereto a water-soluble uv absorbing light attenuating chemical composition to effect a desired degree of light attenuation in substantially the 350 to 380 nanometer bandwidth range, along with up to forty additional volumetric percent of a $C_1 - C_2$ monohydric alcohol to achieve a viscosity for application;

applying said coating in a manner to uniformly cover both surfaces of said apertured member, the viscosity of said coating effecting a bridging meniscus of coating in each aperture and a uniform covering for the interstitial material between apertures;

positioning said aperture member in an inverted manner to effect uniform coating coverage and excess coating run-off therefrom; and drying said coated mask in an environment of moving air whereof the velocity is of a level insufficient to disrupt said coating meniscus.

3. A process for temporarily modifying the apertured pattern member of a cathode ray tube according to claim 2 wherein said $C_1 - C_2$ monohydric alcohol is selected from the group consisting essentially of methanol and ethanol.

4. A process for temporarily modifying the apertured pattern member of a cathode ray tube according to claim 2 wherein the viscosity of said applied coating is within the range of 60 to 100 centipoises.

* * * * *

UNITED STATES PATENT OFFICE

CERTIFICATE OF CORRECTION

PATENT NO. 3,931,442

DATED January 6, 1976

INVENTOR(S) Peter H. Rollason

It is certified that error appears in the above-identified patent and that said Letters Patent are hereby corrected as shown below:

Col. 4, line 31: "multi-apertured" should read --- each ---

Col. 4, line 67: "44" should read --- 41 ---

Col. 5, line 41: "of" should read --- or ---

Signed and Sealed this

*thirtieth* Day of *March 1976*

[SEAL]

*Attest:*

RUTH C. MASON
*Attesting Officer*

C. MARSHALL DANN
*Commissioner of Patents and Trademarks*